US010995502B2

(12) United States Patent
Field et al.

(10) Patent No.: US 10,995,502 B2
(45) Date of Patent: May 4, 2021

(54) COVER MEMBER AND END CAP FOR WALL GUARD AND CORNER GUARD

(71) Applicant: Itasca Plastics, Inc., St. Charles, IL (US)

(72) Inventors: Eric A. Field, Wheaton, IL (US); Matthew W. Field, Wheaton, IL (US)

(73) Assignee: Itasca Plastics, Inc., St. Charles, IL (US)

( * ) Notice: Subject to any disclaimer, the term of this patent is extended or adjusted under 35 U.S.C. 154(b) by 0 days.

(21) Appl. No.: 16/001,588

(22) Filed: Jun. 6, 2018

(65) Prior Publication Data

US 2019/0376299 A1 Dec. 12, 2019

(51) Int. Cl.
*E04F 19/02* (2006.01)

(52) U.S. Cl.
CPC ..... *E04F 19/02* (2013.01); *E04F 19/022* (2013.01); *E04F 19/028* (2013.01)

(58) Field of Classification Search
CPC ..... E04F 19/02; E04F 19/028; E04F 19/022
USPC ..... 52/718.01, 718.04, 287.1, 288.1
See application file for complete search history.

(56) References Cited

U.S. PATENT DOCUMENTS 1,250,594 A * 12/1917 Knapp ..... E04F 19/0436 52/288.1
3,707,061 A * 12/1972 Collette ..... E04F 19/0463 52/288.1
3,712,003 A * 1/1973 Hallock ..... E04F 19/028 52/254
3,717,968 A * 2/1973 Olsen ..... E04F 19/028 52/288.1
4,012,878 A 3/1977 Ellingson
4,083,592 A * 4/1978 Rubin ..... B60R 13/04 428/31
4,104,839 A 8/1978 Balzer et al.
4,161,853 A * 7/1979 Weiss ..... E04F 19/028 52/254
4,430,833 A * 2/1984 Balzer ..... E04F 19/028 52/255
4,999,961 A * 3/1991 McNary ..... E04F 19/024 52/287.1
5,001,877 A * 3/1991 Edwards ..... B44C 5/00 403/295
5,013,596 A * 5/1991 Kessler ..... E04F 19/026 24/293

(Continued)

FOREIGN PATENT DOCUMENTS

JP 06248772 A * 9/1994

OTHER PUBLICATIONS

JP-06248772 machine translation (Year: 2020).*

*Primary Examiner* — Brent W Herring
(74) *Attorney, Agent, or Firm* — Erickson Law Group, PC

(57) ABSTRACT

Embodiments of the invention provide a corner guard and a wall guard, and a method of installing the corner guard and a wall guard that reduces the installation time and provides an improved aesthetic appearance. A corner guard and a wall guard each includes an elongated cover member that is terminated at one end, or both ends, by an end cap. The end cap is sonically welded or otherwise adhered directly to the cover member rather than being attached separately to an underlying base member. The cover member with end cap can then be slid on or snapped onto the underlying base member together.

18 Claims, 12 Drawing Sheets

(56) References Cited

U.S. PATENT DOCUMENTS 5,033,244 A * 7/1991 Ullman ..... A47B 13/083 52/288.1
5,096,753 A * 3/1992 McCue ..... A47B 95/043 24/293
5,110,650 A * 5/1992 Kessler ..... E04F 19/026 24/293
5,233,804 A * 8/1993 Miller ..... E04F 19/028 52/254
5,297,011 A * 3/1994 Triunfol ..... E04F 19/028 362/147
5,363,617 A * 11/1994 Miller ..... E04F 19/028 248/345.1
RE35,971 E * 11/1998 Kessler ..... E04F 19/026 428/100
6,263,630 B1 * 7/2001 Bennett ..... E04F 19/028 52/174
6,354,049 B1 * 3/2002 Bennett ..... E04F 19/028 52/287.1
6,427,401 B2 8/2002 Bennett
6,625,950 B1 * 9/2003 Shreiner ..... E04F 11/1804 52/288.1
6,748,716 B1 * 6/2004 Peck, Jr. ..... E04F 19/026 293/136
7,591,118 B2 * 9/2009 Shaw ..... E04D 13/15 52/287.1
7,743,581 B2 * 6/2010 Shaw ..... E04D 13/15 52/287.1
8,371,081 B2 * 2/2013 Bennett ..... E04F 19/028 52/255
8,828,522 B1 9/2014 Bennett et al.
2007/0119107 A1 * 5/2007 Shaw ..... E04D 13/15 52/287.1
2011/0315298 A1 * 12/2011 Bennett ..... E04F 19/028 156/71

* cited by examiner

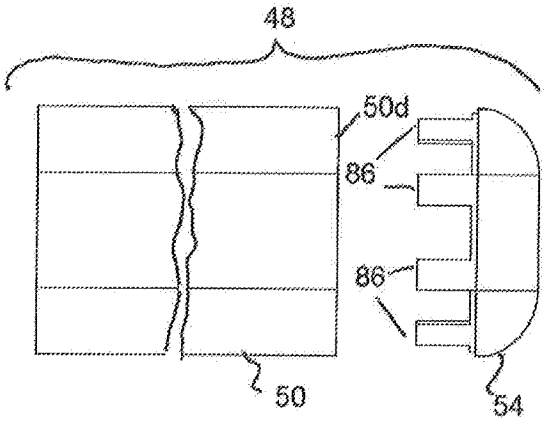
FIG. 7
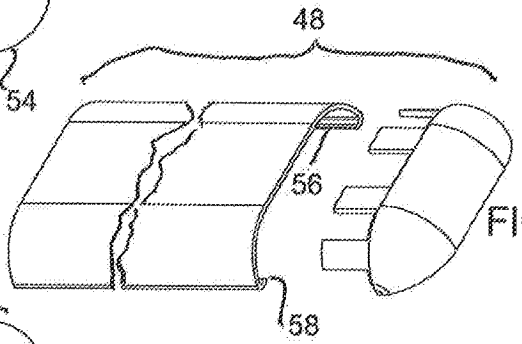
FIG. 6
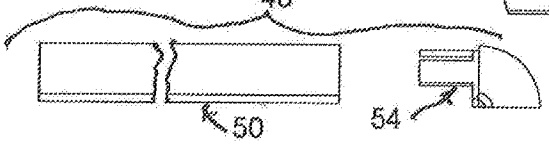
FIG. 8
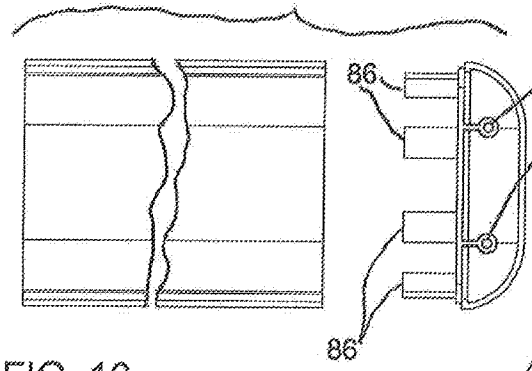
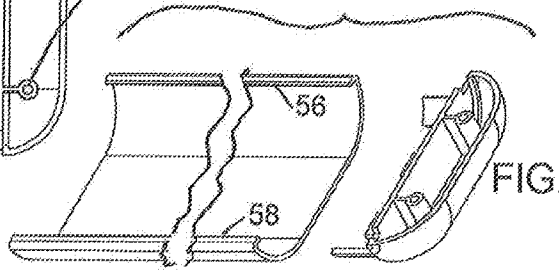
FIG. 9
FIG. 10

COVER MEMBER AND END CAP FOR WALL GUARD AND CORNER GUARD

BACKGROUND OF THE INVENTION

Wall and door mounted guard structures for buildings are useful to protect doors and walls from impact damage especially in high traffic areas. Walls are typically constructed of plaster wall board and are susceptible to impact damage. High traffic areas can be in hallways in schools, hospitals, nursing homes, and other buildings where there is heavy pedestrian traffic. These locations must also accommodate the movement of equipment in and out of hallways and doors that are vulnerable to impact damage. Such equipment can be patient beds, gurneys, wheel chairs, etc. Accordingly, these locations often employ wall and door guards and other such protection structures to guard against the wear and tear often associated with these uses.

Corners are susceptible to impact damage because it is often difficult to navigate corners with large wheeled equipment. Corner guards are useful to absorb impacts by moving equipment. Horizontal wall guards are useful in high traffic areas of buildings to deflect and deform under impacts from objects to prevent damage to the underlying wall. These wall guards are widely used in hospitals and nursing homes, as wall protection where carts, wheelchairs and the like are moved through hallways and are likely to strike the walls.

A prior art wall guard 10 and a corner guard 14 are shown n FIGS. 23-25. The wall guard is installed generally horizontally against the wall 16 and the corner guard 14 is installed vertically over a wall corner 20. The wall 16 and the corner 20 are typically constructed of plaster wallboard and are susceptible to impact damage.

As shown in FIG. 24, prior art wall guards include an aluminum base member 24 fastened to the wall 16 by fasteners 25, and a plastic cover member 28, such as a vinyl cover member, in the form of a channel, applied over the base member 24. The cover member includes curved lips 29, 31 at opposite lateral side edges that slide under or snap under raised flanges 33, 35 at opposite lateral edges of the base member 24. Vinyl end caps (not shown) are secured to the base member 24, such as described in U.S. Pat. No. 8,828,522, and the cover member 28 is snapped or slid onto the base member 24 up to and abutting the end cap.

FIG. 25 illustrates the construction of a corner guard 14. For the most part it is identical to the wall guard of FIG. 24 except that an angled base member 40 replaces the based member 24 and an angled cover member 41 replaces the cover member 28. The remaining features are the same and carry the same reference numbers.

The wall guard and the corner guard, if assembled correctly, can provide a smooth visual transition between cover and end cap. However, the present inventors have recognized that assembling and installing the cover member and end cap onto the base member is time consuming and requires accurate measuring and precise installation. In some cases, inaccurate installation results in a visual gap between the cover member and the end cap.

The present inventors have recognized that it is desirable to provide a wall guard that is not susceptible to the foregoing problems. The present inventors have recognized that it would be desirable to provide a corner guard that is not susceptible to the foregoing problems. The present inventors have recognized that it would be desirable to provide a wall guard and a corner guard that are aesthetically pleasing by providing a smooth, flush transition between an elongated cover member and an end cap. The present inventors have recognized that it would be desirable to provide a wall guard and a corner guard that are more easily and quickly installed, and require less accuracy and precision for installation.

SUMMARY OF THE INVENTION

Embodiments of the invention provide a wall guard cover and a corner guard cover, and a method of installing the wall guard cover and corner guard cover that reduces the installation time and provides an improved aesthetic appearance. The embodiments of the invention provides a wall guard cover and a corner guard cover that include an elongated cover member that is terminated at one end, or both ends, by an end cap. According to the embodiments, the end cap is sonically welded directly to, or otherwise integrated with, the cover member rather than being attached to an underlying base member. The cover member with end cap can then be slid on, or snapped onto, the underlying base member.

According to another enhancement, an arrangement allows for an end cap to be attached to an end adaptor wherein each of the end cap and the adaptor have attachment tabs for attaching to two cover members to form a wall guard corner cover that overlies a building corner.

Numerous other advantages and features of the present invention will be become readily apparent from the following detailed description of the invention and the embodiments thereof, and from the accompanying drawings.

BRIEF DESCRIPTION OF THE DRAWINGS

FIG. 6 is an exploded front, bottom perspective view of a wall guard of FIG. 1;

FIG. 7 is an exploded front view of the wall guard of FIG. 1;

FIG. 8 is an exploded bottom view of the wall guard of FIG. 1;

FIG. 9 is an exploded rear perspective view of the wall guard of FIG. 1;

FIG. 10 is an exploded rear view of the wall guard of FIG. 1;

DETAILED DESCRIPTION

Figure 1:
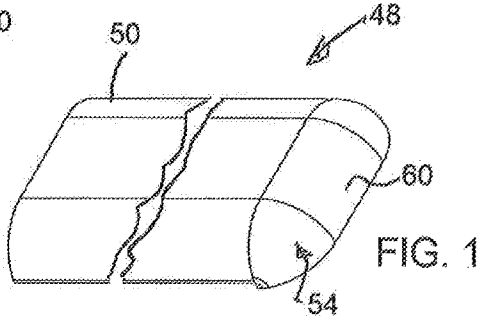
FIG. 1 is a front, bottom perspective view of a wall guard of the present invention in an assembled state.
Figure 2:
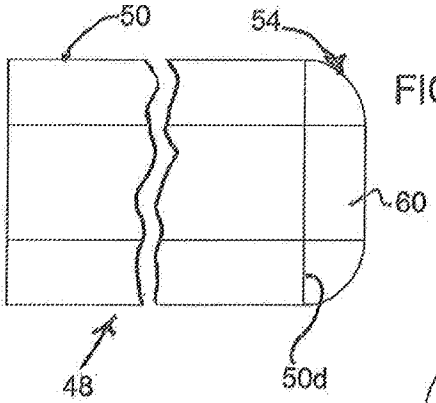
FIG. 2 is a front view of the wall guard of FIG. 1.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

FIGS. 1-10 illustrate an embodiment of a wall guard cover 48 including a cover member 50 and an end cap 54. The cover member and the end cap are advantageously composed of a polymer such as PVC, PETG, Polycarbonate or other suitable material.

Figure 23:
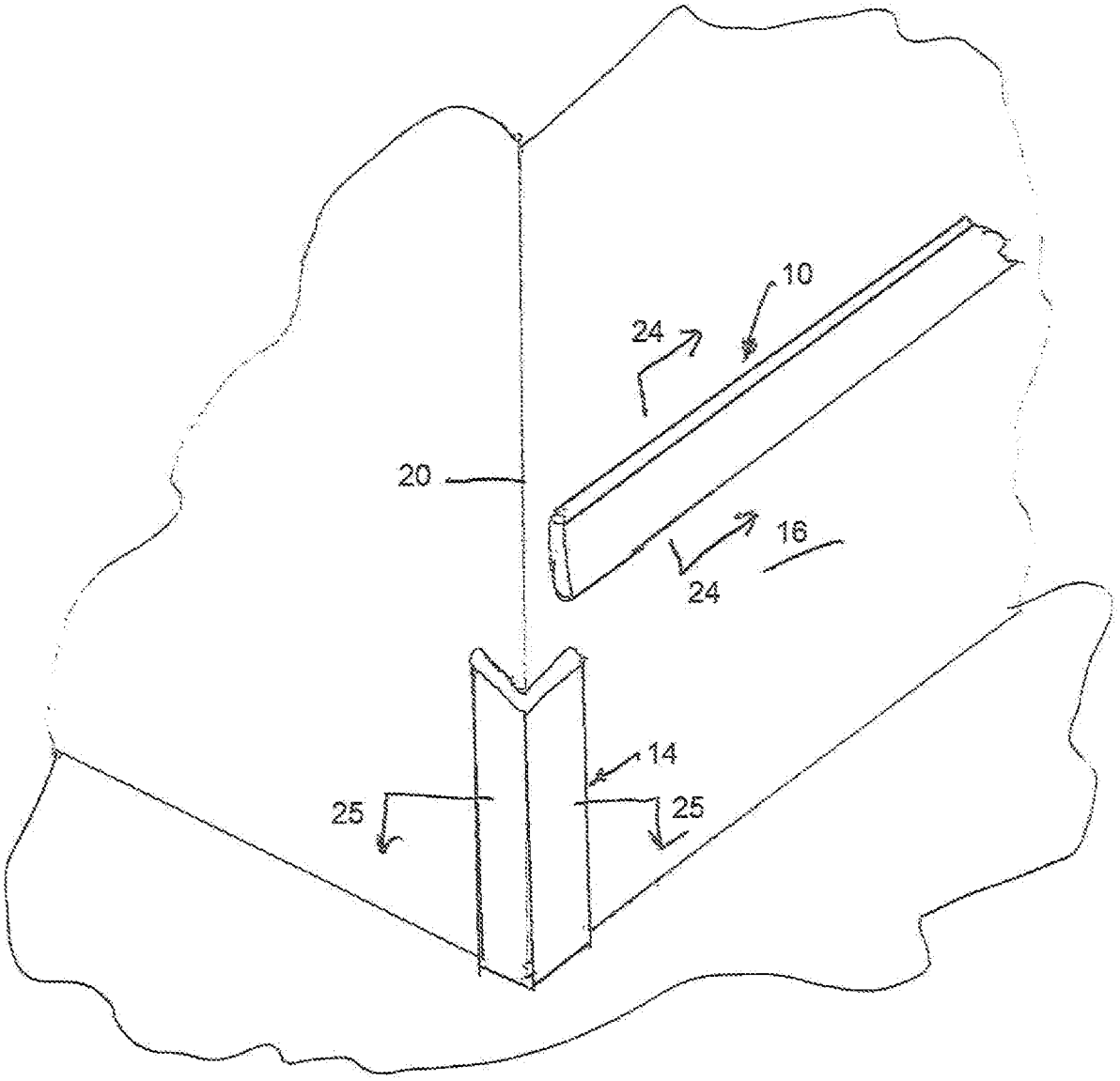
FIG. 23 PRIOR ART
FIG. 23 is a fragmentary perspective view of a prior art installation of a corner guard and a wall guard.
Figure 24:
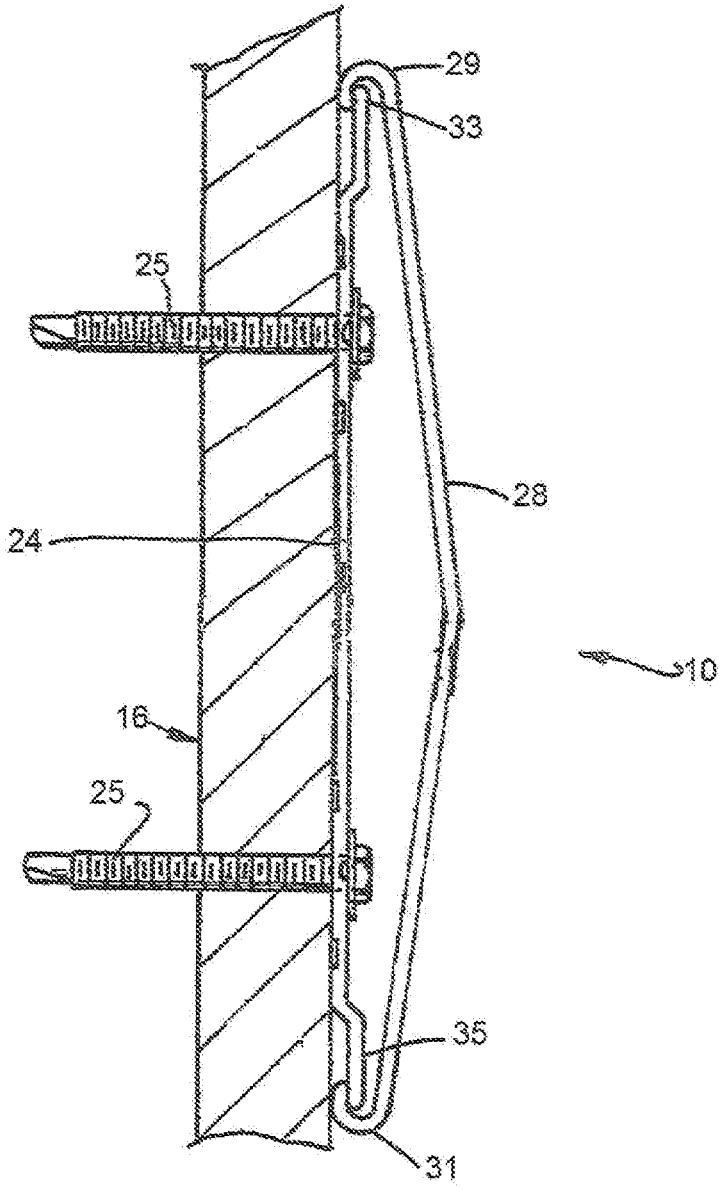
FIG. 24 PRIOR ART
FIG. 24 is a sectional view taken along line 24-24 of FIG. 23.

The cover member 50 is elongated and intended to be mounted onto a base member in similar fashion to the wall guard illustrated in FIGS. 23 and 24. In this regard, the cover member 50 includes upper and lower lips 56, 58 for sliding over or snapping around flanges on the base member.

Figure 3:
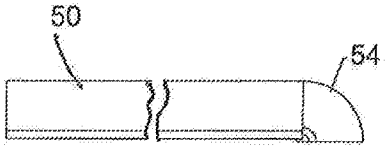
FIG. 3 is a bottom view of the wall guard of FIG. 1.
Figure 4:
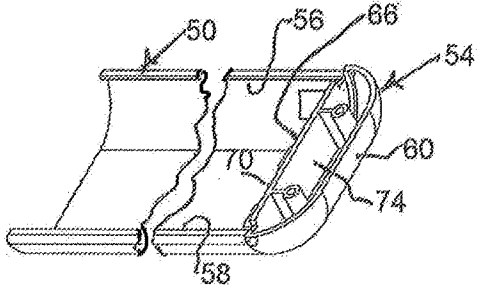
FIG. 4 is a rear perspective view of the wall guard of FIG. 1.
Figure 5:
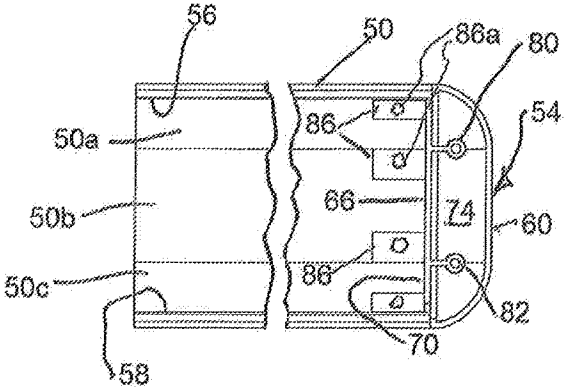
FIG. 5 is a rear view of the wall guard of FIG. 1.
Figure 11:
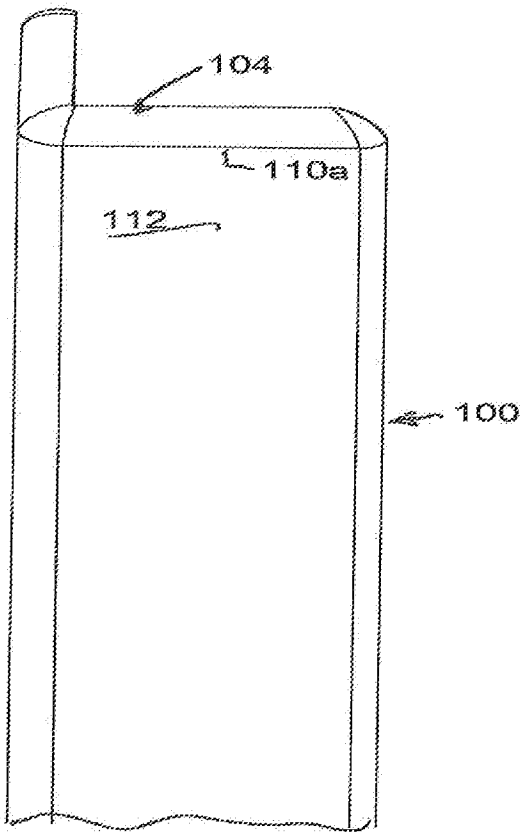
FIG. 11 is a front, top perspective view of a 90 degree corner guard of the present invention in an assembled state.
Figure 12:
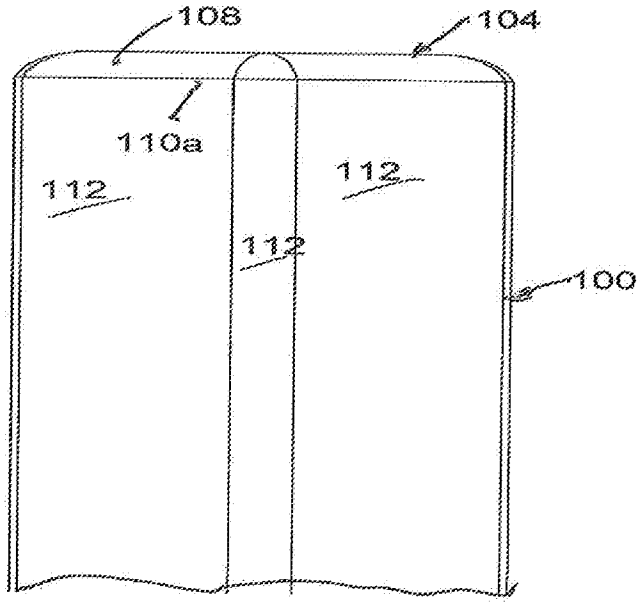
FIG. 12 is a front view of the corner guard of FIG. 11.

The end cap 54 includes an outer wall 58 with a first outer surface 60 that forms a rounded 90 degree angle in profile or cross section between a vertical face 54*a* and a horizontal end face 54*b* as shown in FIG. 3. The end cap includes a substantially flat end wall 66 that is connected around a mutual edge between the end wall and the outer wall. The end wall has a second outer surface 70. The outer wall 58 and the end wall 66 define a cavity 74 therebetween. Within the cavity 74 are two, spaced-apart screw-receiving bosses 80, 82 attached to the end wall 66. The purpose of the bosses 80, 82 is explained below with respect to FIGS. 21 and 22.

Attachment tabs 86 are arranged extending perpendicularly from the end wall 66 to fit snugly against inside surfaces 50*a*, 50*b*, and 50*c* of the cover member 50. The connection between the end wall 66 and the outer wall 54 is stepped around its perimeter so that the end wall fits snugly just within a perimeter formed by the cover member 50 and the wall upon which the wall guard is mounted, and the outer wall 54 abuts an end 50*d* of the cover member 50.

The attachment tabs 86 are sonically spot welded, shown as 86*a*, or otherwise attached to the inside surfaces 50*a*, 50*b*, 50*c* of the cover member 50. This attachment can advantageously be done in the factory before the stock components are sent to the work site for installation. Because the end caps are installed to the cover members and not to the base member, it is assured that the end caps 54 will fit tightly and flushly to the cover members 50 without gaps and without depending on precise installation of the cover members to the end caps already installed onto the base members.

Figure 25:
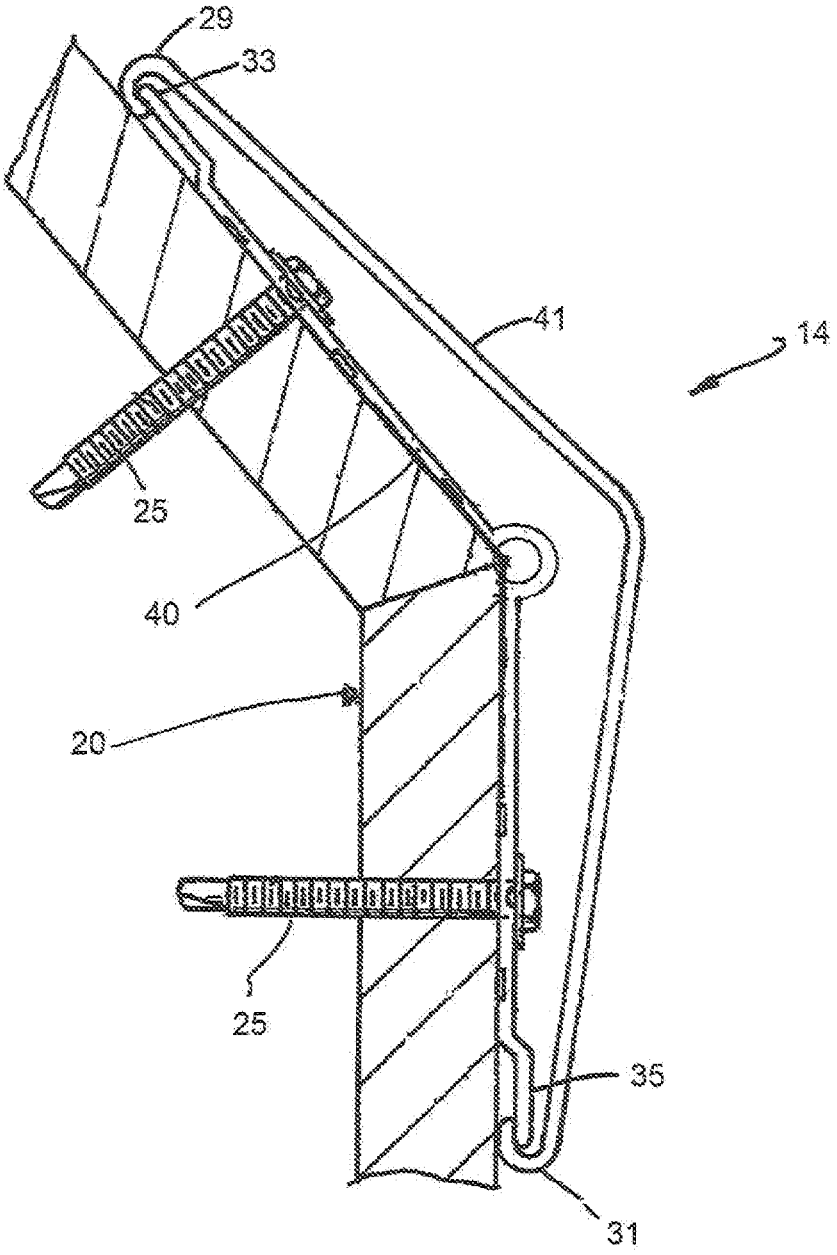
FIG. 25 PRIOR ART
FIG. 25 is a sectional view taken generally along line 25-25 of FIG. 23.

FIGS. 11-20 describe embodiments of the invention directed to corner guards. A corner guard is installed substantially as described in FIGS. 23 and 25. The present invention provides an improved installation of an end cap for a corner guard.

FIGS. 11-14 illustrate an elongated, right-angle cover 90 including a cover member 100 attached to an end cap 104. The cover member and the end cap are advantageously composed of a polymer such as PVC, PETG, Polycarbonate or other suitable material.

Figure 14:
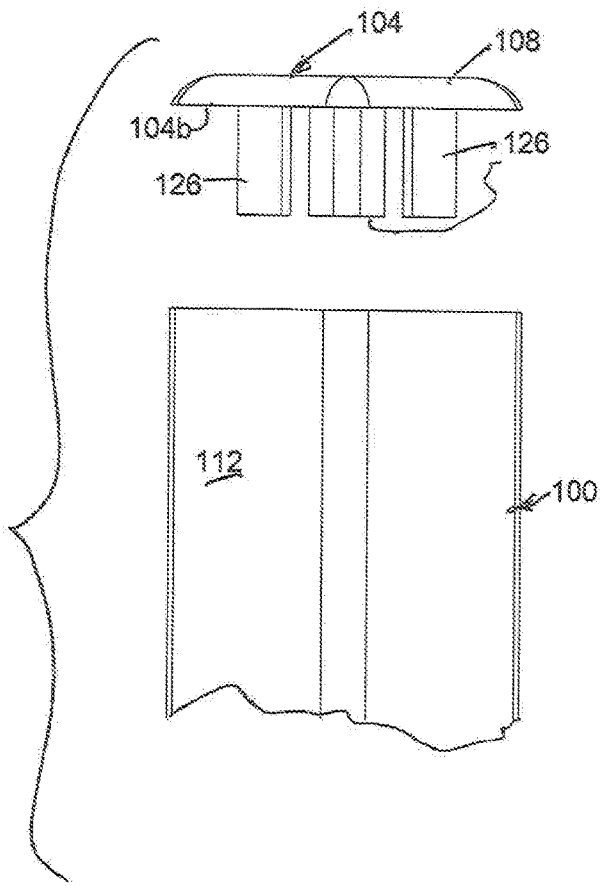
FIG. 14 is an exploded front view of the corner guard of FIG. 11.
Figure 13:
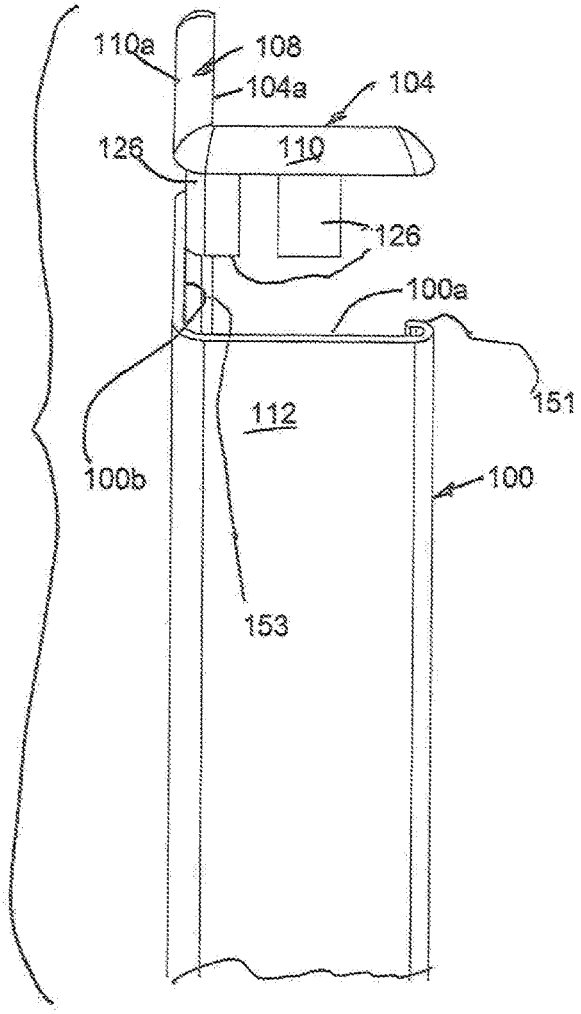
FIG. 13 is an exploded front, top perspective view of the 90 degree corner guard of FIG. 11.
Figure 15:
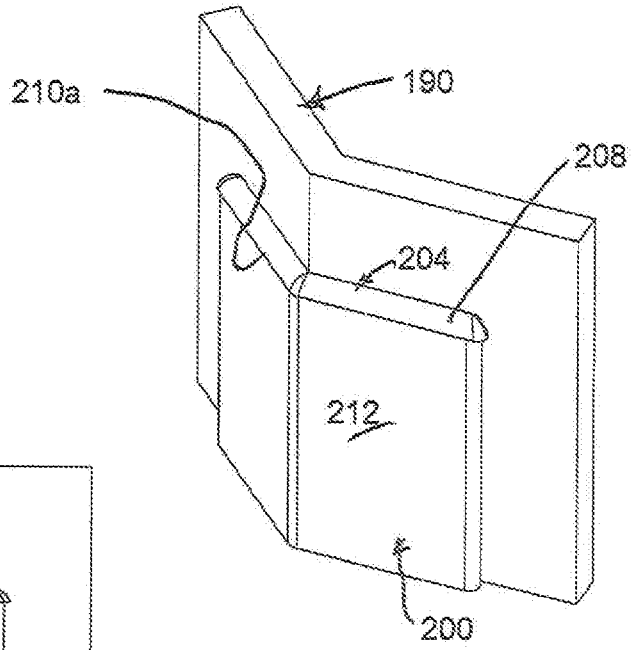
FIG. 15 is a front, top perspective view of a 135 degree corner guard of the present invention in an assembled state.
Figure 16:
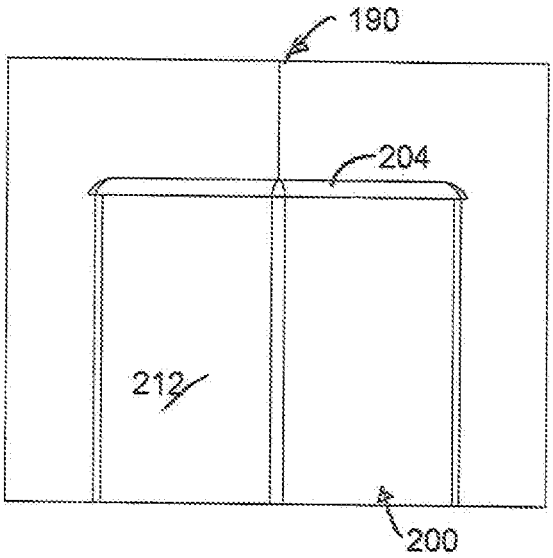
FIG. 16 is a front view of the corner guard of FIG. 15.

The corner guard cover member 100 and the end cap 104 are configured to fit together and protect a 90 degree building corner. The cover member 100 has an angular outer surface 112 forming substantially a right angle. The end cap 104 includes an outer wall 108 formed as a right angle and having a first outer surface 110 that forms a rounded 90 degree angle in profile or cross section between a vertical face 104*a* and a horizontal face 104*b* as shown in FIGS. 13 and 14. Attachment tabs 126 are arranged extending vertically from an inside surface of the outer wall 108, offset inward from an outer edge 110*a* so as to fit snugly against inside surfaces 100*a*, 100*b* of the cover member 100, with the outer edge 110*a* fitting flushly with the outer surface 112 of the cover member.

The attachment tabs 126 are sonically spot welded or otherwise attached to the inside surfaces 100*a*, 100*b* of the cover member 100. This attachment can advantageously be done in the factory before the stock components are sent to the work site for installation, but can also be done at the work site. Because the end caps are installed to the cover members and not to the base member, it is assured that the end caps 104 will fit tightly and flushly to the cover members 100 without gaps and without depending on precise installation of the cover members to the end caps already installed onto the base members.

Figure 17:
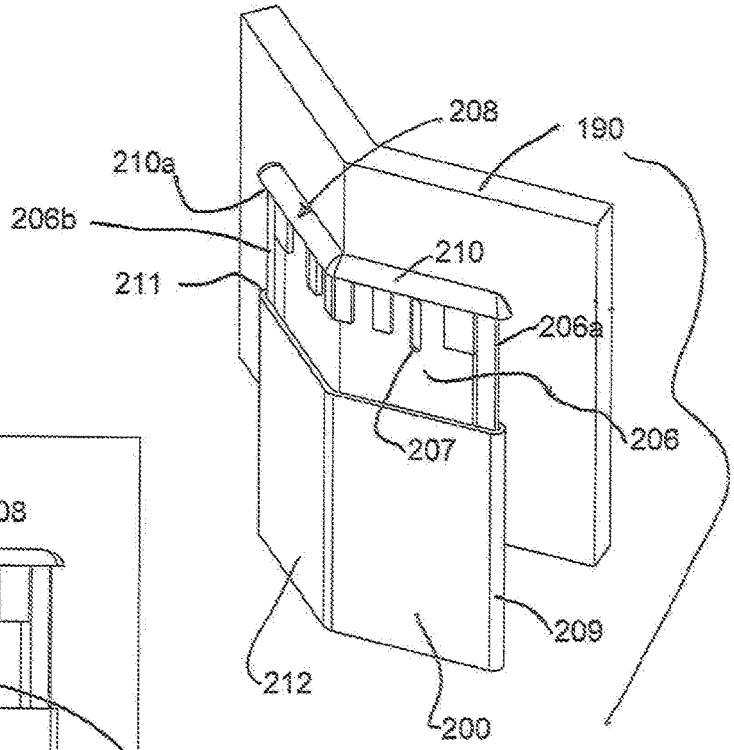
FIG. 17 is an exploded front perspective view of the 135 degree corner guard of FIG. 15, with portions removed for viewing underlying components.
Figure 18:
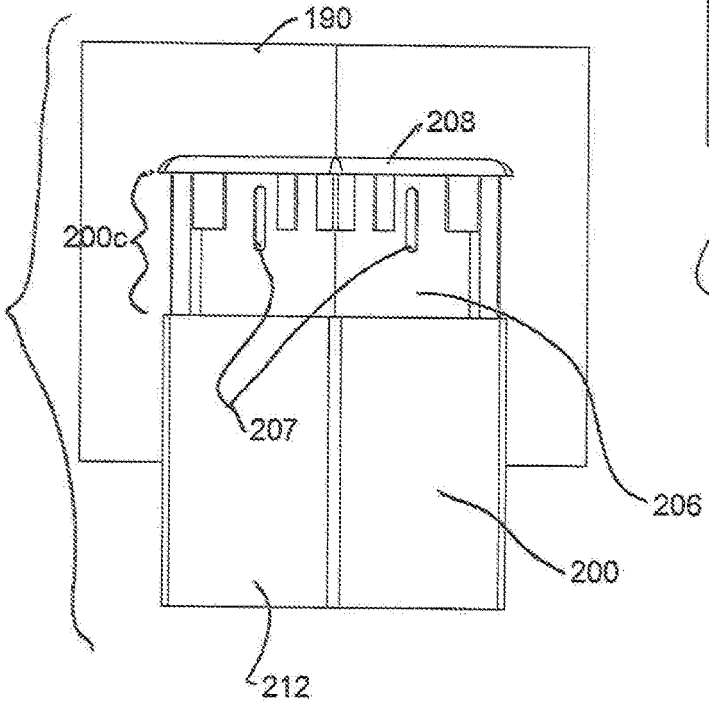
FIG. 18 is an exploded front view of the corner guard of FIG. 15, with portions removed for viewing underlying components.

The cover member 100 includes vertical edge, curved lips 151, 153 that are used to snap or slide the cover member onto a base member, such as described in the next embodiment and FIGS. 17 and 18.

FIGS. 15-20 show a similar corner guard cover 180 to that shown in FIGS. 11-14 except that the corner guard extends around a 135 degree building corner 190 rather than a 90 degree angle building corner as in FIGS. 11-14.

FIGS. 15-20 illustrate the corner guard cover 180 includes an elongated, angled cover member 200 attached to an end cap 204. The cover member and the end cap are advantageously composed of a polymer such as PVC, PETG, Polycarbonate or other suitable material.

The corner guard cover member 200 and the end cap 204 are configured to fit together and onto a base member 206 (FIG. 17) to protect a 135 degree building corner. FIGS. 17 and 18 show the cover member 200 and end cap 204 installed onto the base member 206 which is visible because an upper portion 200*c* of the cover member has been removed to view underlying parts. The base member 206 includes elongated slots 207 used for attaching the base member to the wall 190 with fasteners. The cover member includes vertical edge curved lips 209, 211 that snap onto or slide onto edge flanges 206*a*, 206*b* that are raised slightly away from the wall 190.

Figure 19:
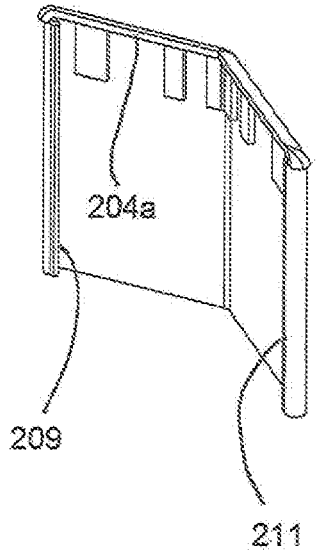
FIG. 19 is a rear perspective view of the corner guard of FIG. 15.
Figure 20:
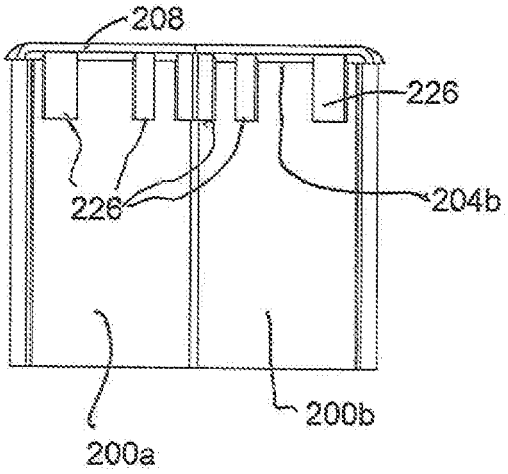
FIG. 20 is a rear view of the corner guard of FIG. 15.

The cover member 200 has an angular outer surface 212 forming substantially a 135 degree angle in horizontal cross section. The end cap 204 includes an outer wall 208 formed as a 135 degree angle and having a first outer surface 210 that forms a rounded 90 degree angle in profile or cross section between a vertical face 204*a* and a horizontal face 204*b* as shown in FIGS. 19 *b* and 20. Attachment tabs 226 are arranged extending vertically from an inside surface of the outer wall 208, offset inward from an outer edge 210*a* to fit snugly against inside surfaces 200*a*, 200*b* of the cover member 200, with the outer edge fitting substantially flushly with the outer surface 212 of the cover member.

The attachment tabs 226 are sonically spot welded or otherwise attached to the inside surfaces 200*a*, 200*b* of the cover member 200. This attachment can advantageously be done in the factory before the stock components are sent to the work site for installation. In this manner, it is assured that the end caps 204 will fit tightly and flushly to the cover members 200 without gaps and without depending on precise installation of the cover members to the end caps already installed onto the base members.

Figure 21:
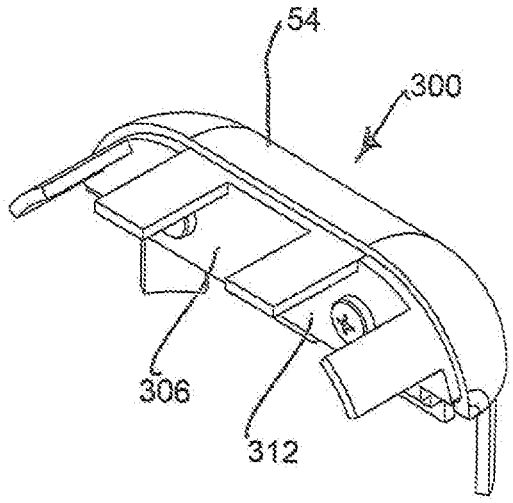
FIG. 21 is a perspective view of an end cap and adaptor assembly for a wall guard corner assembly.
Figure 21A:
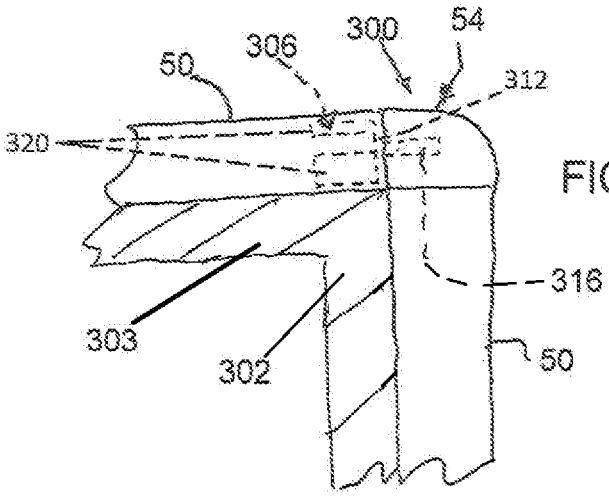
FIG. 21A is a plan view of the assembly of FIG. 21 with the building wall shown in section.
Figure 22:
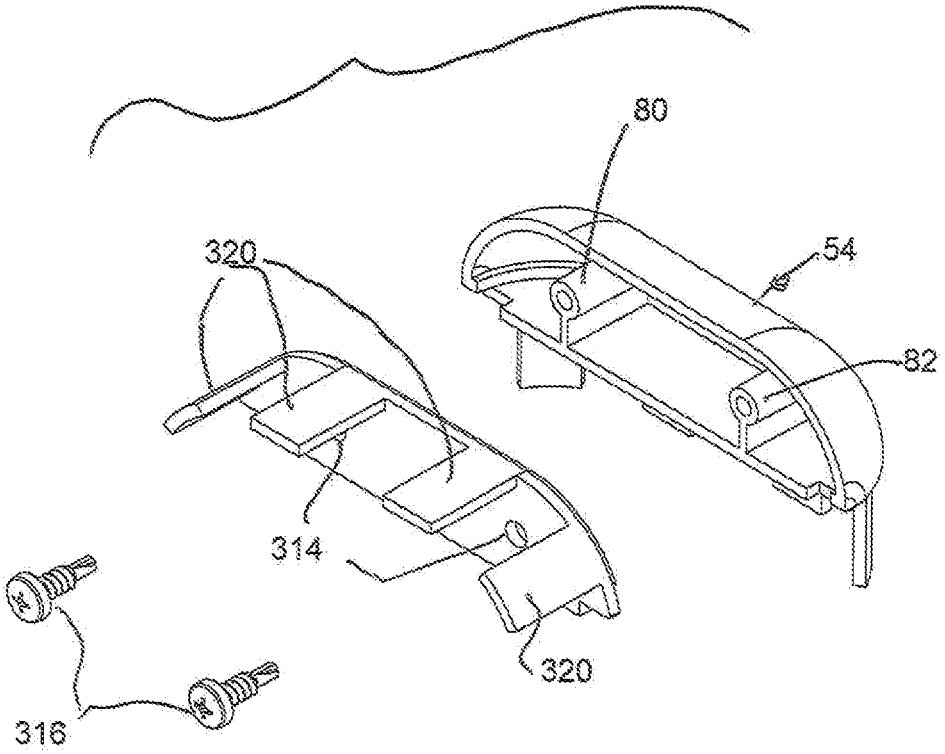
FIG. 22 is an exploded perspective view of the end cap and adaptor assembly of FIG. 21.

FIGS. 21, 21A and 22 describe a corner attachment assembly 300 for a wall guard. The end cap 54 is attached to a first cover member 50 and extends past one wall 302 of a building corner and is attached to an end adaptor 306 extending past the adjacent wall 303 of the building corner. The end adaptor 306 includes a flat end wall 312 having pair of plain holes 314 that receive screws 316 that are threaded into the screw bosses 80, 82 of the end cap 54. The end adaptor 306 includes attachment tabs 320 extending away from the flat end wall 312 and are configured in similar fashion to the attachment tabs 86 of the end cap 54. The attachment tabs 320 are to be sonically welded or otherwise attached to the inside surfaces 50*a*, 50*b*, 50*c* of a second cover member 50, that forms a corner with the first cover member to overlie and protect a building corner.

The embodiments of the invention, shown in the FIGS. 1-22 provide a one piece wall guard cover 48 or a one piece corner guard cover 90, 180 for fitting onto a base member. The one piece guard covers 48, 90, 180 include a cover member and an end cap. Advantageously, attachment tabs of the end caps are sonically welded to the cover member to form the one piece cover. Alternatively the end caps can be adhered to the cover members using heat welding, adhesive, chemical bonding, or other means to integrate the end caps with the cover members.

From the foregoing, it will be observed that numerous variations and modifications may be effected without departing from the spirit and scope of the invention. It is to be understood that no limitation with respect to the specific apparatus illustrated herein is intended or should be inferred.

All references, including publications, patent applications, and patents, cited herein are hereby incorporated by reference to the same extent as if each reference were individually and specifically indicated to be incorporated by reference and were set forth in its entirety herein, to the extent that the references are not inconsistent with the present disclosure.

The invention claimed is:

1. A wall guard system comprising:

a base member fastened to a building wall, the base member having side flanges along opposite side edges of the base member;

a first cover member overlying the base member and having side edge lips configured to engage the side flanges of the base member; and an end cap shaped to fit over a free end of the first cover member, the end cap having at least one cap attachment tab arranged to be closely adjacent to an inside surface of the first cover member, the cap attachment tab secured to the inside surface of the first cover member, the end cap attached to the cover member independently of the base member or the building wall;

further comprising an end adapter, wherein the end cap includes at least one screw boss to receive a screw to attach the end cap to the end adaptor, the end adaptor includes at least one adapter attachment tab to attach the end adaptor to a second cover member, identical in cross section to the first cover member and arranged at a right angle to the first cover member to form a corner overlying the building corner.

2. The wall guard system according to claim 1, wherein the base member and first cover member are arranged horizontally to overlie a flat building wall.

3. The wall guard system according to claim 1, wherein the end cap includes an outer wall and an end wall, the outer wall and the end wall form a cavity, the outer wall forming a rounded 90 degree profile.

4. The wall guard system according to claim 1, wherein the cap attachment tab is sonically welded to the inside surface.

5. The wall guard system according to claim 1, wherein the cap attachment tab is attached to the inside surface by sonic welding, heat welding, adhesive bonding or chemical bonding.

6. A wall guard system according to claim 1, wherein the end cap has an end cap end edge and the first cover member has a cover end edge, and when the end cap is attached to the first cover member, the end cap end edge and the cover end edge abut and form a flush outer surface transition between the cover member and the end cap, the at least one cap attachment tab protrudes past the end cap end edge and is arranged to be closely adjacent to an inside surface of the first cover member, the cap attachment tab adhered to the inside surface of the first cover member.

7. A wall guard system according to claim 1, wherein the at least one adapter attachment tab comprises plural attachment tabs.

8. A cover for a wall guard comprising:

an elongated cover member shaped to be fit over a base member on a building wall; and an end cap adhered to the cover member and shaped to conceal the base member at an end of the cover member, the end cap attached to the cover member independently of the base member or the building wall, wherein the end cap includes at least one cap attachment tab that is adhered to the cover member by sonic welding, heat welding, adhesive bonding or chemical bonding;

further comprising an end adapter, wherein the end cap includes at least one screw boss to receive a screw to attach the end cap to the end adaptor, the end adaptor includes at least one adapter attachment tab to attach the end adaptor to a further cover member, identical in cross section to the cover member and arranged at a right angle to the cover member to form a corner overlying the building corner.

9. The cover according to claim 8, wherein the at least one cap attachment tab is adhered to the cover member by sonic welding, heat welding, adhesive bonding or chemical bonding.

10. The cover according to claim 8, wherein the at least one cap attachment tab includes plural cap attachment tabs that are spaced apart and are adhered to an inside surface of the cover member by sonic welding, heat welding, adhesive bonding or chemical bonding.

11. The cover according to claim 8, wherein the at least one cap attachment tab includes plural cap attachment tabs that are spaced apart and are adhered to an inside surface of the cover member by sonic welding.

12. The cover according to claim 11, wherein the cap attachment tabs are attached to an inside surface of the cover member by sonic welding.

13. The cover according to claim 8, wherein the cover member and end cap are composed of a polymer.

14. The cover according to claim 8, wherein the cover member is arranged horizontally to overlie a flat building wall.

15. The cover according to claim 8, wherein the end cap includes an outer wall and an end wall, the outer wall and the end wall form a cavity, the outer wall forming a rounded 90 degree profile.

16. The cover according to claim 8, wherein the cap attachment tab is attached to an inside surface of the cover member by sonic welding.

17. The cover according to claim 8, wherein the end cap has an end cap end edge and the cover member has a cover end edge, and when the end cap is attached to the cover member, the end cap end edge and the cover end edge abut, forming a flush outer surface transition between the cover member and the end cap, and the at least one cap attachment tab, protrudes past the end cap end edge and is arranged to be closely adjacent to an inside surface of the cover member, the cap attachment tab secured to the inside surface.

18. The cover according to claim 8, wherein the at least one adapter attachment tab comprises plural attachment tabs.

* * * * *